US010446980B2

(12) United States Patent
Wittmann

(10) Patent No.: US 10,446,980 B2
(45) Date of Patent: Oct. 15, 2019

(54) ELECTRICAL PLUG CONNECTION

(71) Applicant: Robert Bosch GmbH, Stuttgart (DE)

(72) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/072,959

(22) PCT Filed: Jan. 23, 2017

(86) PCT No.: PCT/EP2017/051264

§ 371 (c)(1),
(2) Date: Jul. 26, 2018

(87) PCT Pub. No.: WO2017/129500

PCT Pub. Date: Aug. 3, 2017

(65) Prior Publication Data

US 2019/0036273 A1 Jan. 31, 2019

(30) Foreign Application Priority Data

Jan. 29, 2016 (DE) ..... 10 2016 201 391

(51) Int. Cl.
*H01R 13/629* (2006.01)
*H01R 107/00* (2006.01)

(52) U.S. Cl.
CPC . *H01R 13/62977* (2013.01); *H01R 13/62911* (2013.01); *H01R 13/62944* (2013.01); *H01R 2107/00* (2013.01); *H01R 2201/26* (2013.01)

(58) Field of Classification Search
CPC ..... H01R 13/62; H01R 13/453; H01R 13/62927; H01R 13/62977; H01R 13/6244

(Continued)

(56) References Cited

U.S. PATENT DOCUMENTS 5,322,448 A * 6/1994 Hahn ..... H01R 13/62944 439/153
5,518,412 A * 5/1996 Larabell ..... H01R 13/62938 439/153

(Continued)

FOREIGN PATENT DOCUMENTS

DE 19651436 A1 6/1998
DE 102011101205 A1 2/2012

(Continued)

OTHER PUBLICATIONS

International Search Report dated Apr. 11, 2017 of the corresponding International Application PCT/EP2017/051264 filedJan. 23, 2017.

*Primary Examiner* — Tulsidas C Patel
*Assistant Examiner* — Peter G Leigh
(74) *Attorney, Agent, or Firm* — Norton Rose Fulbright US LLP; Gerard Messina

(57) ABSTRACT

A plug includes: a housing with a plurality of electrical plug contacts that electrically contact complementary plug contacts of a plugging module in a completely plugged-on position; and a slider movably attached to the housing, including first and second gear rack segments, and configured to engage with the plugging module such that, in response to a movement of the slider relative to the housing, a force is transmitted by the slider to the plugging module by which the plug and plugging module move towards each other or away from each other. A lever is rotationally mounted to the housing so that, responsive to a movement of the lever in one direction, the gear meshes with the first gear rack segment moving the slider in a first movement direction, and subsequently meshes with the second gear rack segment moving the slider in a second opposite movement direction.

14 Claims, 3 Drawing Sheets

(58) Field of Classification Search
USPC ..... 439/372, 157, 159, 160
See application file for complete search history.

(56) References Cited

U.S. PATENT DOCUMENTS

| | | | | |
|---|---|---|---|---|
| 5,564,935 | A * | 10/1996 | Yagi | H01R 13/62966 439/157 |
| 5,873,745 | A * | 2/1999 | Duclos | H01R 13/62944 439/157 |
| 6,652,306 | B2 * | 11/2003 | Karamatsu | H01R 13/62933 439/157 |
| 7,104,819 | B2 * | 9/2006 | Yamaoka | H01R 13/62938 439/153 |
| 7,121,866 | B2 * | 10/2006 | Testa | H01R 13/62927 439/347 |
| 7,134,901 | B2 * | 11/2006 | Okura | H01R 13/4538 439/372 |
| 7,597,569 | B2 * | 10/2009 | Okuda | H01R 13/62955 439/157 |
| 7,695,296 | B1 * | 4/2010 | Hitchcock | H01R 13/62922 439/157 |
| 7,750,789 | B2 * | 7/2010 | Titokis | H01R 13/62944 337/194 |
| 8,192,212 | B2 * | 6/2012 | Casses | B60L 11/1818 439/181 |
| 8,500,476 | B2 * | 8/2013 | Hori | H01R 13/62944 439/310 |
| 9,124,033 | B2 * | 9/2015 | Hirano | H01R 13/62955 |
| 9,564,710 | B2 * | 2/2017 | Ebihara | H01R 13/62938 |
| 2005/0064749 | A1 | 3/2005 | Stella et al. | |
| 2016/0149342 | A1 | 5/2016 | Rodriguez | |

FOREIGN PATENT DOCUMENTS

| | | | |
|---|---|---|---|
| EP | 0933836 | A2 | 8/1999 |
| JP | H07201116 | A | 8/1995 |
| WO | 02078126 | A2 | 10/2002 |

* cited by examiner

ELECTRICAL PLUG CONNECTION

CROSS-REFERENCE TO RELATED APPLICATIONS

The present application is the national stage of International Pat. App. No. PCT/EP2017/051264 filed Jan. 23, 2017, and claims priority under 35 U.S.C. § 119 to DE 10 2016 201 391.2, filed in the Federal Republic of Germany on Jan. 29, 2016, the content of each of which are incorporated herein by reference in their entireties.

FIELD OF THE INVENTION

The present invention relates to a plug, as well as to an electrical plug connection, which includes a plug and a plugging module, and can be used, for example, to connect a wiring harness to an electrical device.

BACKGROUND

In order to assemble electrical plug connections, in particular, multi-pole plug connections, operating elements for transmitting force are used to satisfy the ergonomic requirements for the operating forces. Levers, sliders or a combination of the two elements, which then mate, are customary in this case.

In this context, the operating elements can include sliding-block tracks, with which one or more pins on the collar of the plugging module engage. By reasonably designing the sliding-block tracks, a transmission ratio, which is as high as possible, is achieved in the transformation of the insertion movement of the plug into the plugging module, to the movement at the operating element (for example, at an end of a lever or at a handle of a slider).

In addition, it is known that levers can be used as operating elements, where a gear rack can be moved by motion of a lever, via a gear, and/or by a gear, in order to assemble the plug connection.

In practice, the force transmission is often limited by the space available and the associated, available operating path of the operating element. DE 19 651 436 A1 shows a plug system, in which, in order to slip a plug onto a corresponding mating component, a slider displaceably supported at the plug and at the mating component is displaceable with the aid of a lever.

SUMMARY

In the case of a plug connection, example embodiments of the present invention advantageously allow a high assembling force to be generated by transmission via a slider element, so that only a small operating force is necessary and, simultaneously, the space necessary can be kept small.

The present invention relates to an electrical plug connection made up of a plug and a plugging module. The electrical plug connection can be used, for example, to connect a wiring harness to an electrical device. For example, the electrical plug connection can be used in a motor vehicle, such as a passenger car, truck or bus.

According to an example embodiment of the present invention, the plug connection includes a plug having a housing, which possesses a plurality of electrical plug contacts 16; and a plugging module having a plurality of complementary plug contacts, which contact the electrical plug contacts electrically in a completely inserted position of the plug on the plugging module. The plug connection can be a multi-pole plug connection, and thus, can have a plurality of plug contacts. Both the plug and the plugging module can each have a housing, in which the plug contacts are supported, and/or which, as a rule, is made of plastic.

The plug can be guided in the plugging module in such a manner that the plug is movable only in a plugging direction or a direction opposite to the plugging direction, between a placed-on position and a completely inserted position. In the placed-on position, the plug can be put on a collar of the plugging module (the electrical plug contacts of the plug and of the plugging module not contacting electrically). In the completely inserted position, the plug can be pushed into and/or over the collar up to an end stop (the electrical plug contacts of the plug and of the plugging module then making electrical contact).

In addition, the plug includes a slider element, which is movably attached to the housing and is configured to engage with the plugging module in such a manner, that in response to a movement of the slider element relative to the housing, a force is transmitted by the slider element to the plugging module, which means that the plug and the plugging module are moved towards each other in a plugging direction or away from each other in a direction opposite to the plugging direction. The slider element can be understood as a mechanical transmission element of the plug, which mechanically translates a movement of an operator, that is, of the lever, into an insertion movement.

For example, the slider element can be displaceable with respect to the housing and simultaneously connected to the housing and/or mounted to the housing, in such a manner, that the slider element can transmit forces to the housing. Such a mounting can be provided, for example, by a linear guideway, an axis of rotation, a groove, etc.

In addition, the plug includes a lever, which is rotationally mounted to the housing, in order to rotate a gear; and a first gear rack segment and a second gear rack segment, which are both provided by the slider element, and with which the gear meshes, in particular, in succession, so that in response to a movement of the lever in one direction, the gear meshes with the first gear rack segment and moves the slider element in a first movement direction, and subsequently, the gear meshes with the second gear rack segment and moves the slider element in a second movement direction opposite to the first movement direction.

The movement of the lever in a direction can be a movement in a single direction, that is, no change of direction in the movement is necessary, which means that the assembly operation is simplified.

The gear rack segments, which are provided by the slider element, can be positioned on, and/or undetachably mounted to, the slider element. The gear rack segments can be formed on the slider element in such a manner, that they are not displaceable with respect to the slider element.

The gear does not mesh with the first gear rack segment and with the second gear rack segment simultaneously (with the possible exception of at a transition region at two ends of the first and second gear rack segments facing each other). On the contrary, the first and second gear rack segments are positioned relative to each other in such a manner, that in the event of a movement of the gear by the lever, the gear meshes initially with the first gear rack segment and subsequently with the second gear rack segment. For example, with respect to the axis of the gear, at least sections of the gear rack segments can be set apart from each other by a distance D, which is greater than the largest diameter of the gear (calculated over its teeth).

The two gear rack segments can each be situated on a separate gear rack, these two gear racks then being able to be elements separate from each other. However, the gear rack segments can also be situated on a common gear rack.

The gear can be attached to the housing so as to be able to rotate about an axis of rotation stationary with respect to the housing.

In other words, using two gear rack segments, a movement of the lever in a direction (that is, either clockwise or counterclockwise) can be translated into a reciprocating movement of the slider element. This reciprocating movement can run substantially parallel to a transverse direction of the plug connection. In this context, it is to be understood that due to a change of the gear from the first gear rack segment to the second gear rack segment of the gear rack, the slider element can also have a (relatively small) displacement in the plugging direction or in a direction opposite to the plugging direction.

The reciprocating movement of the slider element in the first movement direction and the second movement direction (which can both run parallel to the transverse direction) can then be converted by the slider element into two partial movements in the same direction (that is, either in the plugging direction or a direction opposite to the plugging direction), during which the plug is pushed onto the plugging module or disengaged from it. The first and second movement directions can be approximately perpendicular to the direction into which the motive force is converted. For example, the movement directions can run approximately perpendicular to the plugging direction. To that end, the slider element can include inclined planes having variously oriented sections, one or more sliding-block tracks having variously oriented sections, and/or further gear rack segments or gear racks, which are configured to generate the partial movements of the plug with respect to the plugging module, via mechanical translation from the reciprocating motion of the slider element.

In this manner, the entire force translation between the force applied to the lever and the force between the plug and the plugging module can be halved, since due to the two-part movement of the slider element in different directions, two times the distance on the slider element is available. In other words, the operating force can be reduced up to 50%, e.g., 45% or 50%, or even by more than 50%, e.g., up to 60% or up to 75%, in comparison with the operating force without the increased available travel. This can advantageously simplify the assembly markedly, even if a longer path is necessary.

Due to the transmission ratio between the lever and the gear rack segments, the operating procedure does not have to be carried out in two parts and/or in different directions, which can be unfamiliar to an operator. Using a suitable design of the slider element and lever, a change in the direction of travel of the slider element can be caused, although the operating direction of the lever remains the same over the entire closing operation.

According to an example embodiment of the present invention, the first gear rack segment and the second gear rack segment are positioned relative to the gear in such a manner, that a first side of the gear meshes with the first gear rack segment, and a second side of the gear meshes with the second gear rack segment, with the first side of the gear lying essentially diametrically opposite to the second side of the gear. How such a relative set-up of the gear, and the gear rack having its first and second gear rack segments, is to be designed, and how the gear can be coupled to the first and second gear rack segments, in order to provide this set-up, is clear to one skilled in the art.

In this context, the axis of the gear can be situated approximately centrally between the first side of the gear and the second side of the gear.

In response to rotating the gear clockwise, this set-up advantageously causes, e.g., the first gear rack segment of the gear rack to mesh with the first side of the gear (for example, a lower side of the gear), and in this manner, causes the first gear rack segment and, consequently, the slider element to be moved from right to left. Upon crossing over to the second gear rack segment, the second side of the gear (for example, an upper side of the gear) now meshes with the second gear rack segment. The second side of the gear is situated oppositely to the first side, and in the case of the same direction of rotation, now moves the second gear rack segment and, consequently, the slider element from left to right. The reason for this is that the first side of the gear and the second side of the gear lie on different sides of the axis, and, in a plan view of the gear, the teeth of the gear on the first side and the second side move in different directions.

In this manner, the option of obtaining a reversal of movement without changing the operating direction is advantageously provided by a simple, space-saving device (the gear and the first and second gear rack segments positioned relatively to it). Thus, the risk of an operating error is advantageously reduced.

According to an example embodiment of the present invention, a bearing element is provided on the slider element, and a countersupport element is provided in the housing of the plug. The countersupport element has a first guide wall and a second guide wall, which guide the bearing element when the slider element is moved in the first movement direction and the second movement direction. For example, the first guide wall can guide the bearing element in the first movement direction, and the second guide wall can guide the bearing element in the second movement direction. The bearing element and the countersupport element can be positioned and/or set apart relative to each other and/or relative to the gear and/or relative to the gear rack, in such a manner, that the gear cannot come off the first and/or second gear rack segment, as long as the gear has not arrived at the end of one of the two gear rack segments. This applies regardless of whether the gear is meshed with the first or the second gear rack segment.

In other words, the countersupport element always pushes or presses against the bearing element in such a manner, that the gear rack is pressed or pushed against the gear.

If the gear changes over between the two gear rack segments, for example, at the end of the first gear rack segment or, e.g., at the end of the second gear rack segment or, e.g., via a rounded section of a gear rack between the two segments or gear rack segments, the bearing element and the countersupport element can also be suitably shaped, in order to prevent the gear from leaving the gear rack (except in the case of a planned change from the first to the second gear rack segment or segment, at the end). In this manner, the plug or the plug connection advantageously becomes more reliably operable, that is, slippage does not occur during operation, and the risk of a malfunction or of canting is advantageously reduced. In addition, the robustness of the operability with regard to temperature fluctuations and vibrations increases advantageously.

According to an example embodiment of the present invention, the countersupport element includes a rib, which provides the first guide wall and the second guide wall as side walls. The peripheral walls of the rib and/or of the countersupport element can follow a line, which is formed exactly the same as a line, which follows the axis of rotation of the lever or of the gear with respect to the slider element, when it meshes with the gear rack. Alternatively, the peripheral walls of the rib or of the countersupport element can follow the reflection of this line along the plugging direction.

According to an example embodiment of the present invention, the bearing element of the slider element includes a rib, which is configured to slide on the first guide wall and on the second guide wall, using lateral surfaces. A rib, that is, an elongated bearing element, can advantageously oppose canting of the slider element with respect to the housing of the plug. In this manner, the reliability of the mechanism is increased and the risk of slippage is decreased in a further advantageous manner.

According to an example embodiment of the present invention, the first gear rack segment and the second gear rack segment are provided by a (continuous) gear rack. In this context, the first gear rack segment and the second gear rack segment can be connected via a semicircular section of the gear rack. Therefore, all in all, the gear rack can be curved in a U-shape. Thus, e.g., the gear rack can have the shape of a horizontal "U," e.g., in the shape of a "⊂" or in the shape of a "⊃". This advantageously allows a particularly fluid sequence of movements during the transition of the gear from the first gear rack segment to the second gear rack segment, which means that the operability is made easier.

The first gear rack segment and the second gear rack segment can be straight. This simplifies the producibility and the reliability of the mechanism. The risk of slippage decreases. In addition, this advantageously results in different sides of the gear meshing with the first gear rack segment and the second gear rack segment or segment.

According to an example embodiment of the present invention, the first gear rack segment and the second gear rack segment run parallel to the first movement direction and the second, opposite movement direction. This advantageously results in different sides of the gear meshing with the first gear rack segment and the second segment, i.e., the second gear rack segment. Thus, in addition, the reliability of the mechanism is particularly high.

According to an example embodiment of the present invention, the first gear rack segment and the second gear rack segment are situated oppositely to each other in the plugging direction. It is possible for the teeth of the first gear rack segment and of the second gear rack segment to point towards each other. This can have the advantage that the gear can be positioned inside of the two segments or gear rack segments, and that consequently, the displacement of the axis of rotation of the lever in the plugging direction can be kept small, conditional upon the fact that the gear changes between the two segments or gear rack segments. This advantageously results in different sides of the gear meshing with the first gear rack segment and the second segment, i.e., the second gear rack segment. Thus, in addition, the reliability of the mechanism is particularly high, and the producibility is simplified. Furthermore, a particularly small amount of space is necessary for the gear rack, i.e., the two gear rack segments. The risk of the gear not being able to mesh with the second gear rack segment, due to slippage, is advantageously reduced.

However, it is also possible for the teeth of the first gear rack segment and of the second gear rack segment to point away from each other. Using such a set-up, for example, a larger gear having more teeth can be used, through which the operating forces can be further reduced (gear ratio improved) in an advantageous manner. What is crucial is that different sides of the gear mesh with the first gear rack segment and the second gear rack segment, i.e., the second segment.

According to an example embodiment of the present invention, the slider element includes a sliding-block track, in which a pin attached to the plugging module is guidable. A sliding-block track can be an indentation and/or track in or on the slider element, which is bounded by two walls running substantially in parallel. The pin guided by the sliding-block track can have a diameter, which is essentially just as large as the spacing of the walls running in parallel. The pin can be round, but can also include parallel outer surfaces, which are guided by the parallel walls.

In this context, the term "a sliding-block track" and/or "a pin" is to be understood as "at least one sliding-block track" and/or "at least one pin." The simpler term was selected merely for improved readability. The same also applies to the terms "a gear," "a gear rack," "a first gear rack segment," "a second gear rack segment," etc., which are to be understood as "at least one gear," "at least one gear rack," "at least one first gear rack segment," "at least one second gear rack segment," etc.

According to an example embodiment of the present invention, the sliding-block track includes at least a first section and a second section, which are oriented in such a manner, that insertion of the plug into the plugging module in the plugging direction and disengagement of the plug from the plugging module in a direction opposite to the plugging direction is accomplished by moving the slider element in the first movement direction and the second movement direction. Consequently, the reciprocating movement, which is generated by rotating the lever in a single direction, can be translated via the sliding-block track into two partial movements of the plug with respect to the plugging module, which also run in the same direction (in or opposite to the plugging direction).

According to an example embodiment of the present invention, the first section of the sliding-block track and the second section of the sliding-block track are connected via a bend in the sliding block track, at which the sliding-block track changes its direction. At the bend, the sliding-block track can form a knee and/or have a small angle (less than)90° between the first section and the second section. In this bend, the pin switches between the first section and the second section. The relative angle of the first section with respect to the second section at the bend can be less than 90°. In this manner, the mechanism can operate particularly efficiently.

Since the movement direction of the slider element is intended to change when the pin is in the bend, the gear is between the first gear rack segment and the second gear rack segment. In this context, the distance of the first gear rack segment from the second gear rack segment along the plugging direction can be designed so that a displacement of the slider element in the plugging direction with respect to the housing of the plug can be used, in order to move the pin of the plugging module inside of the bend, between the two sections of the sliding-block track.

Thus, e.g., in the case of an exemplary "U"-shaped profile of the gear rack, the gear can be situated in the semicircular section of the gear rack, when the pin is in the bend. In this context, the radius of the semicircular section of the gear rack between the two segments of the gear rack can be designed so that a displacement of the slider element in the plugging direction with respect to the housing of the plug can be used, in order to move the pin of the plugging module inside of the bend, between the two sections of the sliding-block track.

According to an example embodiment of the present invention, the sliding-block track is zigzag-shaped. In other words, the first section and the second section can run at a positive and a negative angle to the plugging direction. These angles determine the transmission ratio of the force applied by the gear to the slider element, to a force applied by the slider element to the pin. The two angles can be of the same magnitude, but can also be of different magnitudes, which results in different forces between the plug and plugging module as a function of the movement direction of the slider element.

In other words, depending on the inclination of the section, the (same) applied operating force can produce forces of differing magnitude between the plug and the plugging module, in the plugging direction.

A slider element including a gear rack having the two segments, i.e., the two gear rack segments, and/or including a sliding-block track and a corresponding pin, can be attached to opposite sides of the plug and/or of the plugging module; the gear rack segments and/or the sliding-block tracks then being able to run parallel to each other on opposite sides. In this manner, the action of a force can be distributed uniformly to the opposing sides of the plug connection.

A further aspect of the present invention relates to a plug for an electrical plug connection, as described above and in the following. According to an example embodiment of the present invention, the plug includes a housing, which has a plurality of electrical plug contacts; a slider element, which is movably attached to the housing; a lever, which is rotationally mounted to the housing, in order to rotate a gear; a first gear rack segment and a second gear rack segment, which are both provided by the slider element, and with which the gear meshes, in particular, meshes in succession, so that in response to a movement of the lever in one direction, the gear meshes with the first gear rack segment and moves the slider element in a first movement direction, and subsequently, the gear meshes with the second gear rack segment and moves the slider element in a second movement direction opposite to the first movement direction.

Specific embodiments of the present invention can be regarded as based, inter alia, on the concepts and findings described below.

In the following, specific embodiments of the present invention are described with reference to the appended figures, although neither the figures nor the description are to be interpreted as limiting the present invention. These figures are merely schematic and not true to scale. In the figures, the same reference characters denote identical or equally acting features.

DETAILED DESCRIPTION

Figure 1A:
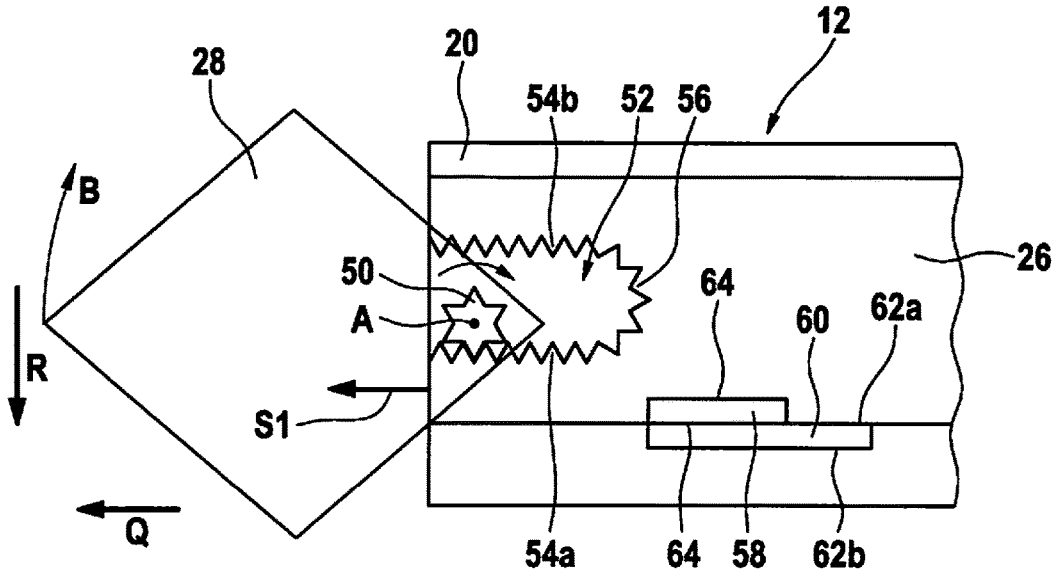
FIG. 1A schematically shows a side view of a plug in a placed-on position, according to an example embodiment of the present invention.
Figure 1B:
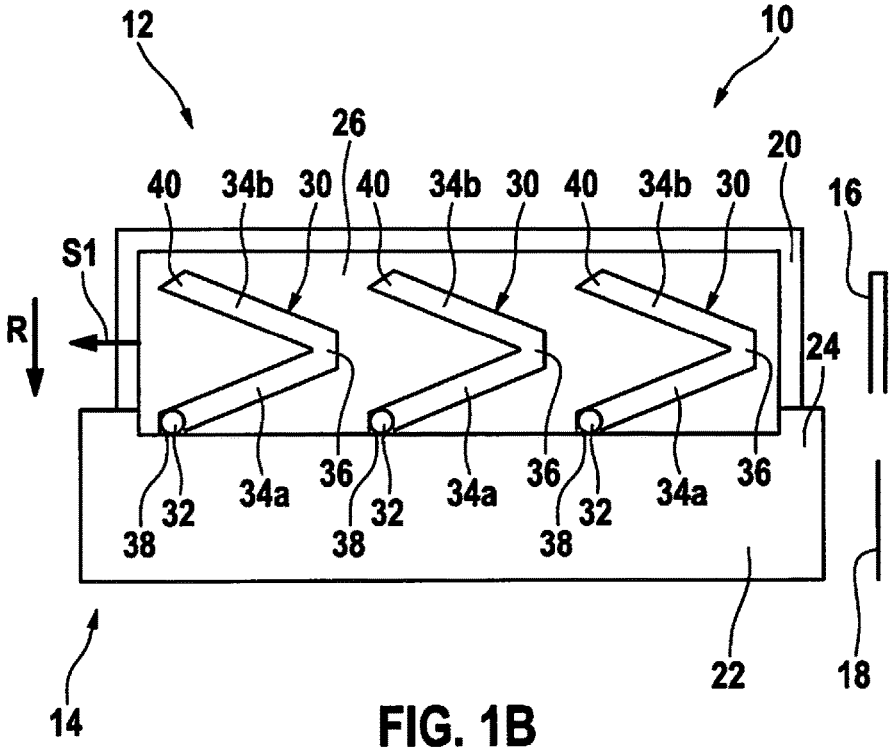
FIG. 1B schematically shows a side view of an electrical plug connection in a placed-on position, according to an example embodiment of the present invention.

FIG. 1A schematically shows an electrical plug 12, which is shown together with a plugging module 14 in FIG. 1B, for implementing an electrical plug connection 10. Plug 12 includes a plurality of plug contacts 16, and plugging module 14 includes a plurality of complementary plug contacts 18, which can be brought into electrical contact by plugging plug 12 in a plugging direction R, onto plugging module 14. For example, plug contacts 18 can be provided in the form of a blade connector.

For example, plugging module 14 is mounted on an electrical device, and the plug is connected, e.g., to a wiring harness. Using electrical plug connection 10, the electrical device can then be connected to the wiring harness.

In FIG. 1B, plug contacts 16, 18 are schematically depicted next to plug 12 and plugging module 14. However, plug contacts 16 are situated inside a housing 20 of plug 12, and plug contacts 18 are situated inside a housing 22 of plugging module 14. Housing 22 of plugging module 14 includes a collar, onto which housing 20 of plug 12 can be plugged, and which then guides plug 12 in plugging direction R. The two housings 20, 22 can be made of plastic.

A slider element 26 is attached to plug 12. Slider element 26 is movable relative to housing 20 of plug 12, in essence, in a direction Q transverse with respect to plugging direction R.

Transverse direction Q can be oriented substantially perpendicularly to plugging direction R. Slider element 26 can also be made of plastic. In this context, slider element 26 is attached to housing 20, so that it can transmit forces to housing 20, in particular, in or opposite to plugging direction R.

Plug 12 further includes a lever 28, which is rotatable about an axis of rotation A at housing 20. A gear 50 rotatable with lever 28 about axis of rotation A is attached to lever 28, the gear meshing with a gear rack 52, which is provided by slider element 26. Gear rack 52 can be implemented as a recess or depression in slider element 26 or at a projection on slider element 26.

In this case, gear rack 52 is U-shaped (i.e., as a horizontal "U") and includes a first gear rack segment 54*a* and a second gear rack segment 54*b*, which run parallel to transverse direction Q, and/or whose teeth point towards each other. The two segments 54*a*, 54*b* are connected by a semicircular section 56 of gear rack 52. In this context, a first side, that is, a lower side of gear 50 with respect to axis A in the figure, meshes initially with first gear rack segment 54*a* (the lower segment in the figure). Subsequently (in FIG. 3A), a second side, that is, an upper side of gear 50 with respect to axis A in the figure, meshes with second gear rack segment 54*b* (the upper segment in the figure).

Slider element 26 further includes a bearing element 58, which interacts with a countersupport element 60 at housing 20 of plug 12. Countersupport element 60, which is manufactured as a rib on housing 20, includes a first guide wall

62*a* (turned upwards in the figure) and a second, parallel guide wall 62*b* (turned downwards in the figure), which run parallel to transverse direction Q, and at which bearing element 58 is guided along by its lateral surfaces 64.

Bearing element 58 and countersupport element 60 are positioned in such a manner that gear 50 is not able to leave gear rack 52, irrespective of the position of gear 50 in gear rack 52, since bearing element 58 and countersupport element 60 are placed on each other in such a manner, that this movement is prevented. In other words, with regard to their dimensions (lengths, widths, diameters) and mutual spacings, bearing element 58, the countersupport element, gear rack 52 and gear 50 are matched to each other in such a manner, that bearing element 58 and countersupport element 60 keep the gear constantly in meshing contact with the gear rack. In the designing of the device, one skilled in the art can easily determine the exact dimensions in view of the figures and adapt them to respective purposes.

Using lever 28, gear 50 and gear rack 52, a reciprocating movement of slider element 26 can be generated by rotating lever 28 in a single movement direction B (here, clockwise).

This reciprocating movement is translated by slider element 26 into two partial movements of plug 12 relative to plugging module 14, which both occur in the same direction (that is, in plugging direction R or against plugging direction R).

In principle, first and second gear rack segments 54*a*, 54*b* can also be elements separate from each other (not depicted here). That is, they can be situated, e.g., on two gear racks separate from each other. For this, FIGS. 1A, 2A, and 3A would need to be imagined without the semicircular connections. In this context, the transition of gear 50 between first and second gear rack segments 54*a*, 54*b* can then be implemented, e.g., via pressure or tension at the housing, in or opposite to plugging direction R.

To that end, as is shown in FIG. 1B, slider element 26 includes a plurality of sliding-block tracks 30, which can each be implemented as a notch or recess in slider element 26, or as two projections set apart on slider element 26. For example, sliding-block tracks 30 can be provided on an inner side of slider element 26, while gear rack 52 is provided at an outer side.

In this case, sliding-block tracks 30 have a zigzag shape. They can be equally spaced apart from one another. Alternatively, or in addition, they can run parallel to each other.

A plurality of pins 32, which are each constructed to be guided in one of the sliding-block tracks, are attached to collar 24 of housing 22 of plugging module 14. Pins 32 can also be spaced apart equally from one another.

It is also possible for only one single sliding-block track 30 and one single pin 32 to be provided.

Each of sliding-block tracks 30 includes a first section 34*a* and a second section 34*b*, which merge at a bend 36. First section 34*a* includes an entrance 38, at which respective pin 32 can be introduced into sliding-block track 30 in a starting position, and/or changes, at its end in bend 36, into second section 34*b*. Second section 34*b* ends at an end point 40 of sliding-block track 30, at which the pin 32 in an end position can no longer be moved further.

In FIGS. 1A-3B, it is shown how plug connection 10 is assembled by operating the lever 28. FIGS. 1A and 1B, 2A and 2B, and 3A and 3B each shows plug 12 or the plug connection at the same times of assembly.

FIG. 1A shows lever 28 in a starting position, while FIG. 1B shows entire plug connection 10 in a plugged-on position, in which plug 12 is put onto plugging module 14 and pins 32 are situated in entrance 38 of sliding-block track 30. Electrical contacts 16, 18 are not in contact. In FIGS. 1B, 2B and 3B, lever 28 is not depicted for the sake of clarity.

Lever 28 is now moved, for example, by an operator, in direction B. In this context, the first side of gear 50 turned downwards meshes with first gear rack segment 54*a* of gear rack 52 and pushes slider element 26 in a first movement direction S1 (thus, in this case, from right to left). In this instance, slider element 26 is guided by bearing element 58, which slides on countersupport element 60.

Due to the movement of slider element 26, the sliding-block tracks 30 running at an angle to movement direction S1, S2 exert a force on pins 32 in plugging direction R. Thus, these pins 32 travel along first section 34*a* of sliding-block track 30, until they are at bend 36, i.e., the transition between first section 34*a* and second section 34*b*, as is depicted in FIG. 1B. In this context, plug 12 is pushed in plugging direction R into plugging module 14, with a first partial movement.

Figure 2A:
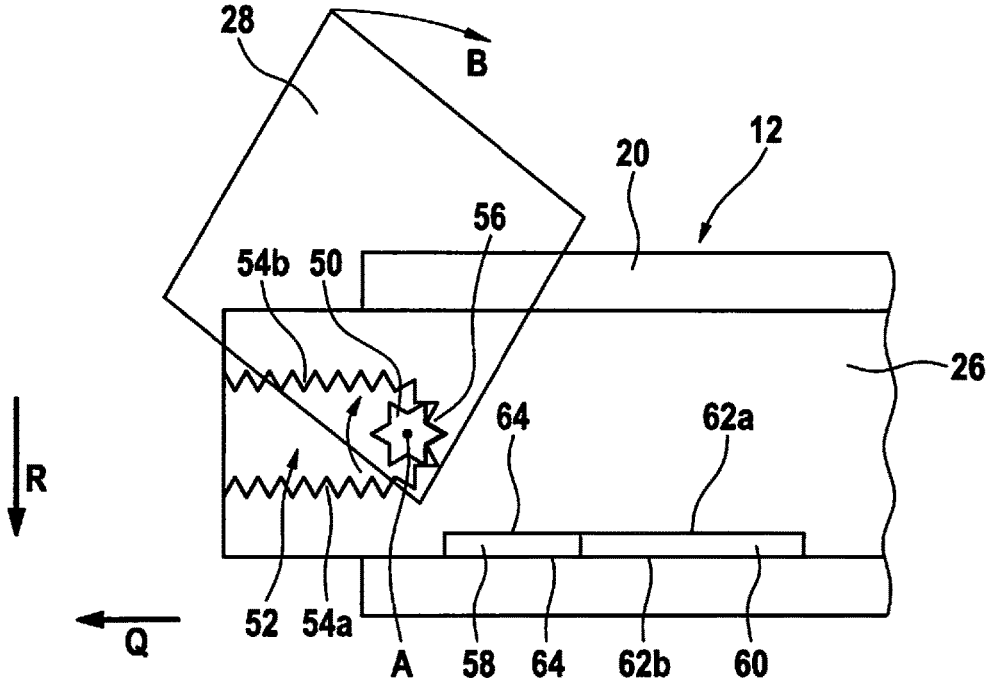
FIG. 2A schematically shows a side view of the plug from FIG. 1A, in a mid-position, according to an example embodiment of the present invention.
Figure 2B:
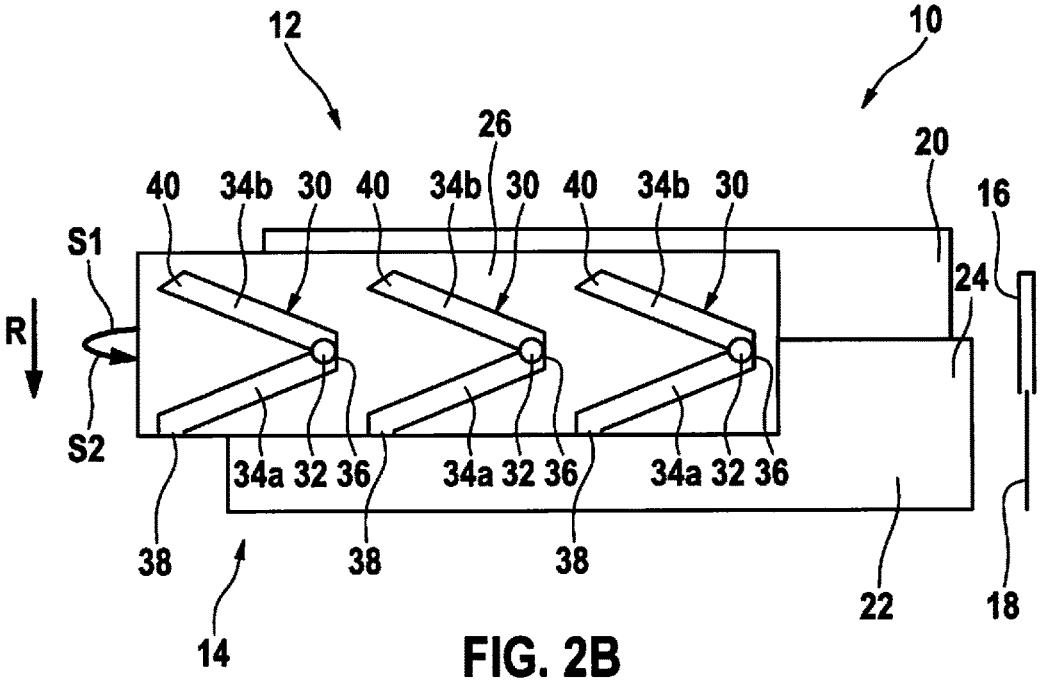
FIG. 2B schematically shows a side view of the electrical plug connection from FIG. 1B, in a mid-position, according to an example embodiment of the present invention.

As shown in FIGS. 2A and 2B, lever 28 and plug connection 10 are now in a mid-position, in which plug 12 can already be partially inserted into plugging module 14, but plug contacts 16, 18 need not have established any electrical contact. In the mid-position, slider element 26 is at a maximum displacement from its starting position.

Gear 50 is now in semicircular section 56, which causes slider element 26 to be moved a (relatively short) distance in plugging direction R. Bearing element 58 is on the side of countersupport element 60 facing transverse direction Q and/or changes sides with countersupport element 60.

In addition, the pins 32 on collar 24 of plugging module 14 are situated in bends 36 of sliding-block tracks 30. The movement of slider element 26 in plugging direction R, which is caused by semicircular section 56 of gear rack 52, can be used for carrying pins 32 over from first section 34*a* of sliding-block track 30 into second section 34*b*.

In response to a further movement of lever 28 in movement direction B, the gear enters second gear rack segment 54*b* of gear rack 52. The second side of gear 50 (the upper side in the figure), which is separated from the first side by axis A, now meshes with second gear rack segment 54*b*. Due to this, slider element 26 now changes from first movement direction S1 to the second movement direction S2 opposite to first movement direction S1. With a second partial movement in plugging direction R, plug 12 is now pushed completely into plugging module 14.

Thus, the movement direction of slider element 26 reverses, since in response to the same direction of rotation (clockwise) of lever 28 and, consequently, of gear 50, the teeth on the lower side of the gear (first side) move from right to left, and the teeth on the upper side of the gear (second side) move from left to right.

Figure 3A:
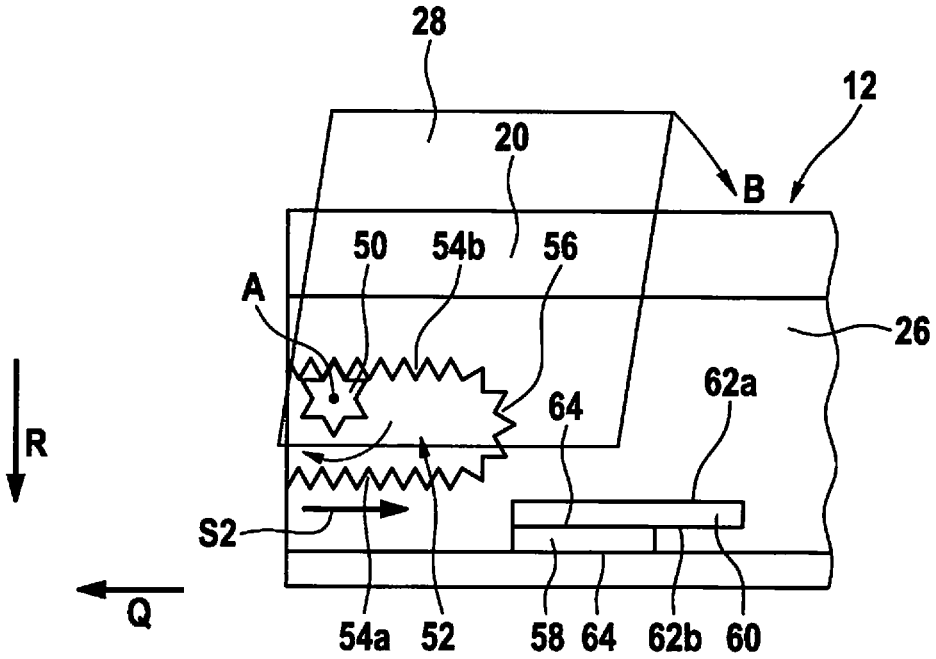
FIG. 3A schematically shows a side view of the plug from FIG. 1A, in a completely inserted position, according to an example embodiment of the present invention.
Figure 3B:
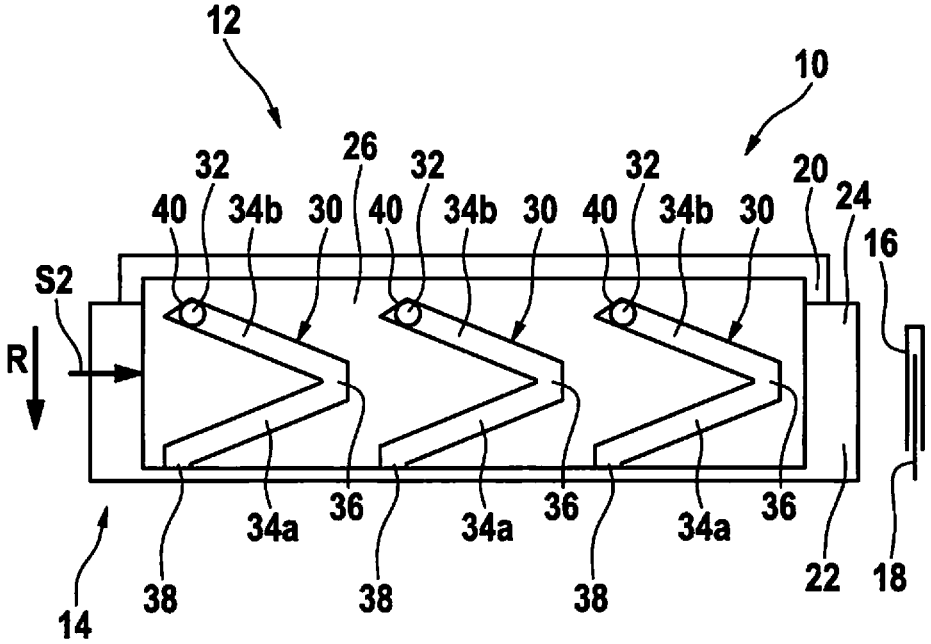
FIG. 3B schematically shows a side view of the electrical plug connection from FIG. 1B, in a completely inserted position, according to an example embodiment of the present invention.

The movement of slider element 26 ends, when the lever reaches an end position, as shown in FIG. 3A. As is depicted in FIG. 3B, pins 32, which have now traveled through second section 34*b*, have reached their final position at end points 40 of sliding-block tracks 30.

Plug connection 10 is now in a completely inserted position, in which plug 12 is pushed into plugging module 14 to a maximum degree and electrical plug contacts 16, 18 are electrically contacted. Slider element 26 is now in the starting position again, in which it takes up a minimum of space.

Disengagement of plug 12 from plugging module 14 can be accomplished by moving the lever in a direction opposite to direction B, during which plug 12, plugging module 14 and slider element 26 move in a manner opposite to the insertion operation.

During the movement of slider element 26, a force is applied to pins 32 by slider element 26, the force acting in parallel with plugging direction R and/or resulting in the insertion or disengagement of plug 12. In this context, sections 34*a*, 34*b* of sliding-block track 30 act as a mechanical force transmission, in which a force on slider element 26 along movement directions 51, S2 is converted to a force parallel to plugging direction R. In this instance, plugging direction R is approximately perpendicular to first and to second movement directions 51, S2.

In this case, the transmission ratio of the force is a function of the angle of sections 34*a*, 34*b* to plugging direction R (i.e., the local angle, at which pins 32 are situated in sliding-block track 30).

The two sections 34*a*, 34*b* can be straight and have, in each instance, the same positive and negative angle with respect to plugging direction R. It is also possible for the angle between section 34*b* and the straight line defined by direction R to be greater than the angle between section 34*a* and this straight line. During the insertion operation, this can be advantageous if at the end, a lot of force must be exerted in order to bring the plug contacts mechanically into contact. For example, if plug contacts 16, 18 are positioned in such a manner, that as of the mid-position, the plug contacts contact and are pushed inside each other, and thus, a higher friction force must be overcome.

In this case, a higher force transmission occurs in second section 34*b* than in first section 34*a*. If pin 32 is in second section 34*b*, then, for example, an assembler can apply less operating force (e.g., at lever 28) than with the pin 32 in first section 34*a*, in order to generate the same insertion force between plug 12 and plugging module 14. At the same operating force, the insertion force between plug 12 and plugging module 14 is greater, when pin 32 is in second section 34*b*. Conversely, the ratio of operating path to insertion path is less for second section 34*b* than in first section 34*a*. In other words, in comparison with first section 34*a*, in second section 34*b*, a relatively long operating path must be covered for a relatively short insertion path.

Finally, it is emphasized that terms, such as "having," "including," etc. do not exclude any other elements or steps, and terms, such as "a" or "an," do not exclude a plurality.

What is claimed is:

1. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction, wherein the slider slides along a linear direction that is transverse to a plugging direction of the plug.

2. The electrical plug connection of claim 1, wherein the first gear rack segment and the second gear rack segment are positioned relative to the gear such that:

a first side of the gear meshes with the first gear rack segment;

a second side of the gear, which lies essentially diametrically opposed to the first side of the gear, meshes with the second gear rack segment.

3. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction;

a bearing element on the slider element;

a countersupport element that is on the housing of the plug and that includes first and second guide walls that guide the bearing element when the slider element is moved in the first and second movement directions.

4. The electrical plug connection of claim 3, wherein the countersupport element includes a rib that forms the first and second guide walls.

5. The electrical plug connection of claim 3, wherein the bearing element of the slider element includes a rib arranged to slide on the first and second guide walls and on the second guide wall using lateral surfaces.

6. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction, wherein the first and second gear rack segments are part of a single gear rack that includes a semicircular section connecting the first and second gear rack segments.

7. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction, wherein the first and second gear rack segments run parallel to the first and second movement directions.

8. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction, wherein the first and second gear rack segments are straight.

9. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction, wherein the first and second gear rack segments are situated opposite to each other in the plugging direction.

10. The electrical plug connection of claim 9, wherein the first and second sections of the sliding-block track are connected via a bend in the sliding-block track at which the sliding-block track changes its direction.

11. The electrical plug connection of claim 10, wherein the sliding-block track has a zigzag shape.

12. The electrical plug connection of claim 9, wherein the sliding-block track has a zigzag shape.

13. An electrical plug connection comprising:

a plug that includes:

a housing, the housing including a plurality of electrical plug contacts; and a slider element movably attached to the housing and including first and second gear rack segments;

a plugging module that:

includes a plurality of complementary plug contacts, which, in a completely plugged-on position of the plug on the plugging module, electrically contact the electrical plug contacts; and is configured to engage with the slider element such that, in response to a movement of the slider element relative to the housing, a force is transmitted by the slider element to the plugging module, so that the plug and the plugging module are moved towards each other in a plugging direction or away from each other in a direction opposite to the plugging direction;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction The electrical plug connection of claim 1, wherein the slider element includes a sliding-block track:

in which a pin attached to the plugging module is guidable; and that includes first and second sections oriented such that they cause movement of the slider element in the first and second movement directions to accomplish insertion of the plug into the plugging module in the plugging direction and disengaging of the plug from the plugging module in the direction opposite to the plugging direction.

14. A plug for an electrical plug connection, the plug comprising:

a housing that includes a plurality of electrical plug contacts;

a slider element movably attached to the housing and including first and second gear rack segments;

a lever rotationally mounted to the housing; and a gear that is rotatable by the lever to, in succession, mesh with the first gear rack segment causing the slider element to move in a first movement direction in response to a movement of the lever in one direction, and subsequently, by a continued rotational motion of the gear, mesh with the second gear rack segment causing the slider element to move in a second movement direction opposite to the first movement direction, wherein the slider slides along a linear direction that is transverse to a plugging direction of the plug.

* * * * *